US008066818B2

(12) United States Patent
Brooker et al.

(10) Patent No.: US 8,066,818 B2
(45) **Date of Patent: *Nov. 29, 2011**

(54) WATER-SOLUBLE POUCH

(75) Inventors: Anju Deepali Massey Brooker, Newcastle/Tyne (GB); Frank William DeNome, Cincinnati, OH (US); Dennis Allen Beckholt, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 259 days.

This patent is subject to a terminal disclaimer.

(21) Appl. No.: 12/365,403

(22) Filed: Feb. 4, 2009

(65) Prior Publication Data

US 2010/0192986 A1 Aug. 5, 2010

Related U.S. Application Data

(60) Provisional application No. 61/065,121, filed on Feb. 8, 2008.

(51) Int. Cl.
*B08B 7/04* (2006.01)
*B08B 3/00* (2006.01)

(52) U.S. Cl. ..... 134/25.2; 134/25.1; 510/439; 510/224

(58) Field of Classification Search ..... 134/25.1, 134/25.2; 53/452, 453, 456, 474, 599, 147, 53/150, 158, 537, 538, 574; 510/220, 224, 510/277, 296, 439

See application file for complete search history.

(56) References Cited

U.S. PATENT DOCUMENTS

| | | | |
|---|---|---|---|
| 3,929,678 | A | 12/1975 | Laughlin et al. |
| 4,115,292 | A | 9/1978 | Richardson et al. |
| 4,246,612 | A | 1/1981 | Berry et al. |
| 4,259,217 | A | 3/1981 | Murphy |
| 4,765,916 | A | 8/1988 | Ogar et al. |
| 4,810,410 | A | 3/1989 | Diakun et al. |
| 4,972,017 | A | 11/1990 | Smith et al. |
| 5,114,611 | A | 5/1992 | Van Kralingen et al. |
| 5,227,084 | A | 7/1993 | Martens et al. |
| RE34,606 | E | 5/1994 | Estell et al. |
| 5,679,630 | A | 10/1997 | Baeck et al. |
| 5,977,053 | A | 11/1999 | Groth et al. |
| 6,312,936 | B1 | 11/2001 | Poulose et al. |
| 2002/0169092 | A1 * | 11/2002 | Alexandre Catlin et al. . 510/220 |
| 2003/0087783 | A1 | 5/2003 | Somerville-Roberts et al. |

FOREIGN PATENT DOCUMENTS

| | | | |
|---|---|---|---|
| EP | 0414549 | A2 | 2/1991 |
| EP | 1375637 | A1 | 1/2004 |
| EP | 1504994 | A2 | 2/2005 |
| GB | 2330362 | A | 4/1999 |
| GB | 2374580 | A | 10/2002 |
| WO | WO 89/06270 | A1 | 7/1989 |
| WO | WO 93/08874 | A1 | 5/1993 |
| WO | WO 93/08876 | A1 | 5/1993 |
| WO | WO 94/02597 | A1 | 2/1994 |
| WO | WO 94/18314 | A1 | 8/1994 |
| WO | WO 94/22800 | A1 | 10/1994 |
| WO | WO 95/01416 | A1 | 1/1995 |
| WO | WO 96/23873 | A1 | 8/1996 |
| WO | WO 96/23874 | A1 | 8/1996 |
| WO | WO 97/43424 | A1 | 11/1997 |
| WO | WO 99/23211 | A1 | 5/1999 |
| WO | WO 00/55045 | A1 | 9/2000 |
| WO | WO 00/60060 | A2 | 10/2000 |
| WO | WO 02/42401 | A2 | 5/2002 |
| WO | WO 02/085736 | A1 | 10/2002 |
| WO | WO 02/092456 | A1 | 11/2002 |
| WO | WO 02/102955 | A1 | 12/2002 |
| WO | WO 2004/111178 | A1 | 12/2004 |
| WO | WO 2005/052146 | A2 | 6/2005 |
| WO | WO 2005/052161 | A2 | 6/2005 |
| WO | WO 2005/123511 | A1 | 12/2005 |
| WO | WO 2006/002643 | A2 | 1/2006 |
| WO | WO 2007/044993 | A2 | 4/2007 |
| WO | WO 2007/145964 | A2 | 12/2007 |

OTHER PUBLICATIONS

International Search Report, 3 pages, May 2009.

* cited by examiner

*Primary Examiner* — Alexander Markoff
(74) *Attorney, Agent, or Firm* — David V. Upite; Julia A. Glazer; Leonard W. Lewis

(57) ABSTRACT

A detergent multi-compartment pouch having a plurality of water-soluble films forming a plurality of compartments the pouch comprising two side-by-side compartments superposed onto another compartment wherein at least two different compartments contain two different compositions.

10 Claims, No Drawings

WATER-SOLUBLE POUCH

This application claims the benefit of U.S. Provisional Application No. 61/065,121, filed 8 Feb. 2008.

TECHNICAL FIELD

The present invention is in the field of detergents, in particular in the field of water-soluble multi-compartment detergent pouches. It relates to multi-compartment detergent pouches comprising two side-by-side compartments superposed onto another compartment wherein at least two different compartments contain at least two different compositions. The pouches of the invention are robust, compact and have a great flexibility in terms of ingredients separation and controlled release.

BACKGROUND OF THE INVENTION

The detergent formulator is constantly looking for new detergent forms with improved cleaning profile. Lately, products in unit dose form have become one of the preferred forms for the user due to the easiness of use, in particular water-soluble pouches which present the added advantage of no need to unwrap.

Products having size and geometry constrictions -as in the case of dishwasher products that need to be dosed through the dispenser and therefore are restricted not only by the size of the dispenser but also by the shape- and ingredients in different physical forms are always challenging from the formulation view point. It is also more challenging when it is desired that the product provides controlled and/or differential release.

The object of the present invention is to design a detergent product which obviates the above challenges.

SUMMARY OF THE INVENTION

According to a first aspect of the present invention, there is provided a detergent multi-compartment water-soluble pouch, preferably a laundry or dishwashing detergent and more preferably a dishwashing detergent pouch. The pouch is formed by a plurality of water-soluble films which form a plurality of compartments. The pouch comprises at least two side-by-side compartments superposed (i.e., placed above) onto another compartment. This disposition contributes to the compactness, robustness and strength of the pouch. The pouch of the invention minimise the amount of water-soluble film required. It only requires three pieces of film to form three compartments. The robustness of the pouch allows also for the use of very thin films without compromising the physical integrity of the pouch. The pouch is also very easy to use because the compartments do not need to be folded to be used in dispensers of fix geometry. At least two of the compartments of the pouch contain two different compositions. By "different compositions" herein is meant compositions that differ in at least one ingredient.

Preferably, at least one of the compartments contains a solid composition and another compartment a liquid composition, the compositions are preferably in a solid to liquid weight ratio of from about 20:1 to about 1:20, more preferably from about 18:1 to about 2:1 and even more preferably from about 15:1 to about 5:1. The pouch of the invention is very versatile because it can accommodate compositions having a broad spectrum of values of solid:liquid ratio. Particularly preferred have been found to be pouches having a high solid:liquid ratio because many of the detergent ingredients are most suitable for use in solid form, preferably in powder form. The ratio solid:liquid defined herein refers to the relationship between the weight of all the solid compositions and the weight of all the liquid compositions in the pouch.

In other embodiments the solid:liquid weight ratio is from about 2:1 to about 18:1, more preferably from about 5:1 to about 15:1. These weight ratios are suitable in cases in which most of the ingredients of the detergent are in liquid form.

In preferred embodiments the two side-by-side compartments contain liquid compositions, which can be the same but preferably are different and another compartment contains a solid composition, preferably in powder form, more preferably a densified powder. The solid composition contributes to the strength and robustness of the pouch. The liquid compositions contribute to the stability of the pouch, in particular if the solid composition comprises moisture sensitive ingredients (such as bleach). This is more so if the compartments superposed onto the solid-containing compartment cover completely the top surface (i.e. the common solid/liquid surface) of the solid-containing compartment.

In other embodiments, the pouch has a volume of from about 10 ml to about 50 ml preferably from about 12 to about 30 and more preferably from about 15 to about 22 ml. Pouches having these volumes have been found particularly suitable from automatic dishwashing product dispenser fit viewpoint. In particular, more suitable pouches have a square or rectangular base and a height of from about 1 to about 5 cm, more preferably from about 1 to about 4 cm. Preferably the weight of the solid composition is from about 10 to about 26 grams, more preferably from about 15 to about 20 grams and the weight of the liquid compositions is from about 0.5 to about 4 grams, more preferably from about 0.8 to about 3 grams.

The pouch of the invention is very versatile in terms of dissolution profile. In preferred embodiments, at least two of the films which form different compartments have different solubility, under the same conditions, releasing the content of the compositions which they partially or totally envelope at different times. The term "solubility" as used herein is not intent to refer to total solubility of a film but to the point at which the pouch in the wash solution breaks to release its content.

Detergent compositions usually comprise detergency enzymes. The enzymes can lose stability in product, due to its interaction with bleach and builders (they can destabilize the enzyme by binding to the calcium of the enzymes). In addition, the performance of enzymes in a cleaning solution can be impaired by the alkalinity of the solution, bleach, builders, etc. In preferred embodiments, one of the compositions of the pouch of the invention, preferably a solid composition, comprises bleach and another composition, preferably a composition in liquid form, comprises enzymes. It is also preferred that one of the films enclosing the enzyme-comprising composition dissolves prior to the films enclosing the bleach-containing composition during the main-wash cycle of an automatic dishwashing machine, thereby releasing the enzyme-containing composition into the wash liquor prior to the delivery of the bleach-containing composition. This gives the enzymes the possibility to operate under optimum condition, avoiding interactions with other detergent actives. The pouch provides excellent cleaning. It is preferred that the bleach-containing composition comprises also a builder.

The cleaning performance can be further improved by having a composition comprising a non-ionic surfactant, in particular a surfactant that helps to suspend soils (herein referred as "anti-redeposition surfactant"). Surfactants having a cloud point above the cleaning temperature have been found to provide excellent cleaning benefits, especially if they are delivered early into the wash liquor. Preferably the surfactant should be part of a liquid composition and more preferably it should be released into the wash liquor as soon as possible (preferably within ten minutes, more preferably within 5 minutes of the wash cycle), thus the surfactant can suspend the soils, in particular greasy soils to facilitate the cleaning carried out by the other components of the detergent composition. If the greasy soils are suspended it is easier for the enzymes and the bleach to access the soil attached to the substrates to be cleaned.

In preferred embodiments, one of the compartments of the pouch contains a rinse aid composition, in particular an automatic dishwashing rinse aid composition to be released into the rinse cycle (i.e., after the main-wash cycle). The films enveloping the rinse aid composition survive the main wash and release their content during the rinse cycle. The remaining compartments of the pouch release their compositions during the main wash.

According to the second aspect of the invention there is provided a method of dishwashing in an automatic dishwashing machine using the pouch of the invention and comprising the steps of placing the pouch into the product dispenser and releasing it during the main-wash cycle.

DETAILED DESCRIPTION OF THE INVENTION

The present invention envisages a multi-compartment pouch. The pouch of the invention has at least three compartments, two side-by-side compartments superposed onto another compartment. The pouch can have more than three compartments, which can be in any disposition, side-by-side, superposed or compartment-inside-compartment. Especially preferred are: i) pouches having three compartments on side-by-side disposition superposed onto a single compartment; and ii) pouches having two side-by-side compartments superposed onto two other side-by-side compartments. Each compartment can contain a detergent composition or part thereof in any physical form, including solid (lose or densified powder, tablet, pre-formed discrete particles, etc), liquids (gels, aqueous liquids, non-aqueous liquids, etc), liquids with solid suspended on them, etc. Especially preferred are pouches having two side-by-side compartments containing two liquid compositions superposed onto a single compartment containing either a liquid or a solid composition.

The pouch of the invention is very effective in terms of separation of incompatible ingredients.

The invention also envisages a method of automatic dishwashing using the pouch of the invention.

The pouch of the invention can contain any kind of detergent composition, preferably the composition is a laundry or dishwashing composition more preferably a dishwashing composition. In some embodiments at least one of the compartments contains a rinse aid composition.

The water-soluble films that form the different compartments can be the same but preferably the films have different solubility and are suitable for delivering the content of different compartments at different points in time of the wash cycle or during the wash and during the rinse cycle.

In some embodiments the pouch of the invention is suitable for delivering different compositions at different points in time of the wash-cycle of an automatic dishwashing machine. Difference in solubility can be achieved by means of films of different thickness or films which solubility is temperature dependent.

In some embodiments the pouch of the invention is suitable for the delivery of a composition during the main-wash cycle and another composition during the rinse cycle. For this purpose the compartments) comprising the rinse aid composition has to survive the main wash and only releases its contents into the rinse cycle. This can be achieved by modifying the thickness of the film and/or the solubility of the film material. The solubility of the film material can be delayed by for example cross-linking the film as described in WO 02/102, 955 at pages 17 and 18. Other water-soluble films designed for rinse release are described in U.S. Pat. Nos. 4,765,916 and 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment pouches with different compartments, where the compartments are made of films having different solubility are taught in WO 02/08380.

Rinse aid compositions promote the wetting of wash articles in order to reduce or eliminate visually observable spotting and filming. Usually they are acidic compositions comprising non-ionic surfactant, dispersant polymer, glass and metal care agents, etc.

Cleaning Actives

Any traditional cleaning ingredients can be used as part of the compositions of the multi-compartment pouch of the invention. The levels given are weight per cent and refer to the total composition of the pouch. The detergent compositions can be built or unbuilt and comprise one or more detergent active components which may be selected from bleach, bleach activator, bleach catalyst, surfactants, alkalinity sources, enzymes, polymeric dispersants, anti-corrosion agents (e.g. sodium silicate) and care agents. Highly preferred detergent components include a builder compound, an alkalinity source, a surfactant, an enzyme and an additional bleaching agent.

Builder

Builders suitable for use herein include builder which forms water-soluble hardness ion complexes (sequestering builder) such as citrates and polyphosphates e.g. sodium tripolyphosphate and sodium tripolyphosphate hexahydrate, potassium tripolyphosphate and mixed sodium and potassium tripolyphosphate salts and builder which forms hardness precipitates (precipitating builder) such as carbonates e.g. sodium carbonate.

Other suitable builders include amino acid based compound or a succinate based compound. The term "succinate based compound" and "succinic acid based compound" are used interchangeably herein.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426, 229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl) glutamic acid (SEGL), N-methyliminodiacetic acid (MIDA), a alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula in which R, R1, independently of one another, denote H or OH, R2, R3, R4, R5, independently of one another, denote a cation, hydrogen, alkali metal ions and ammonium ions, ammonium ions having the general formula R6R7R8R9N+ and R6, R7, R8, R9, independently of one another, denoting hydrogen, alkyl radicals having 1 to 12 C atoms or hydroxyl-substituted alkyl radicals having 2 to 3 C atoms. A preferred example is tetrasodium immino succinate.

Preferably the amino acid based compound or succinate based compound is present in the composition in an amount of at least 1 wt %, preferably at least 5 wt %, more preferably at least 10 wt %, and most preferably at least 20 wt %. Preferably these compounds are present in an amount of up to 50 wt %, preferably up to 45 wt %, more preferably up to 40 wt %, and most preferably up to 35 wt %, It is preferred that the composition contains 20% wt or less of phosphorous-containing ingredients, more preferably 10% wt or less, most preferably that they are substantially free of such ingredients and even more preferably they are free of such ingredients.

Other builders include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts.

Suitable polycarboxylic acids are aqyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

The builder is typically present at a level of from about 30 to about 80%, preferably from about 40 to about 70% by weight of composition. It is also preferred that the ratio of sequestering builder to precipitating builder is from about 10:1 to about 1:1, preferably from about 8:1 to 2:1.

Silicates

Preferred silicates are sodium silicates such as sodium disilicate, sodium metasilicate and crystalline phyllosilicates. The builder is typically present at a level of from about 1 to about 20%, preferably from about 5 to about 15% by weight of composition.

Bleach

Inorganic and organic bleaches are suitable cleaning actives for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability. A suitable coating material providing in product stability comprises mixed salt of a water-soluble alkali metal sulphate and carbonate. Such coatings together with coating processes have previously been described in GB-1,466,799. The weight ratio of the mixed salt coating material to percarbonate lies in the range from 1:200 to 1:4, more preferably from 1:99 to 1 9, and most preferably from 1:49 to 1:19. Preferably, the mixed salt is of sodium sulphate and sodium carbonate which has the general formula Na2S04.n.Na2CO3 wherein n is from 0.1 to 3, preferably n is from 0.3 to 1.0 and most preferably n is from 0.2 to 0.5.

Another suitable coating material providing in product stability, comprises sodium silicate of Si02: Na20 ratio from 1.8:1 to 3.0:1, preferably L8:1 to 2.4:1, and/or sodium metasilicate, preferably applied at a level of from 2% to 10%, (normally from 3% to 5%) Of Si02 by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

The diacyl peroxide, especially dibenzoyl peroxide, should preferably be present in the form of particles having a weight average diameter of from about 0.1 to about 100 microns, preferably from about 0.5 to about 30 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Diacyl peroxides within the above particle size range have also been found to provide better stain removal especially from plastic dishware, while minimizing undesirable deposition and filming during use in automatic dishwashing machines, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 10%, preferably from about 0.5 to about 2% by weight of the composition.

Bleach Catalyst

Bleach catalysts preferred for use herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt(III) and related complexes(U.S. Pat. No. 4,810,410). A complete description of bleach catalysts suitable for use herein can be found in WO 99/06521, pages 34, line 26 to page 40, line 16. Bleach catalyst if included in the compositions of the invention are in a level of from about 0.1 to about 10%, preferably from about 0.5 to about 2% by weight of the composition.

Surfactant

A preferred surfactant for use herein is low foaming by itself or in combination with other components (i.e. suds suppressers). Preferred for use herein are low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of a detergent composition.

In preferred embodiments, the compositions for use herein comprise an anti-redeposition non-ionic surfactant. Ethoxylated alcohols surfactants, preferably essentially free of alkoxy groups other than ethoxy groups, have been found suitable as anti-redeposition surfactants. Preferably the anti-redeposition non-ionic surfactants has a cloud point above wash temperature, ie, above about 50° C., more preferably above about 60° C. Anti-redeposition surfactants seem to emulsify soils, in particular grease soils, preventing re-deposition on the substrates.

"Cloud point", as used herein, is a well known property of surfactants and mixtures thereof which is the result of the surfactant becoming less soluble with increasing temperature, the temperature at which the appearance of a second phase is observable is referred to as the "cloud point" (See KirkOthmer's Encyclopedia of Chemical Technology, 3rd Ed., Vol. 22, pp. 360-362).

In preferred embodiments, the composition comprises a mixture of an anti-redeposition surfactant and a low foaming non-ionic surfactant acting as a suds suppressor. In the case in which the anti-redeposition surfactant comprises an ethoxylated alcohol, preferably the ethoxylated alcohol and the suds suppressor are in a weight ratio of at least about 1:1, more preferably about 1.5:1 and even more preferably about 1.8:1. This is preferred from a performance point of view.

Preferred anti-redeposititon surfactants for use herein include both liner and branched alkyl ethoxylated condensation products of aliphatic alcohols with an average of from about 4 to about 10, preferably form about 5 to about 8 moles of ethylene oxide per mol of alcohol are suitable for use herein. The alkyl chain of the aliphatic alcohol generally contains from about 6 to about 15, preferably from about 8 to about 14 carbon atoms. Particularly preferred are the condensation products of alcohols having an alkyl group containing from about 8 to about 13 carbon atoms with an average of from about 6 to about 8 moles of ethylene oxide per mole of alcohol. Preferably at least 25%, more preferably at least 75% of the surfactant is a straight-chain ethoxylated primary alcohol. It is also preferred that the HLB (hydrophilic-lipophilic balance) of the surfactant be less than about 18, preferably less than about 15 and even more less than 14. Preferably, the surfactant is substantially free of propoxy groups. Commercially available products for use herein include Lutensol®TO series, C13 oxo alcohol ethoxylated, supplied by BASF, especially suitable for use herein being Lutensol®TO7.

Amine oxides surfactants are also useful in the present invention as anti-redeposition surfactants include linear and branched compounds having the formula:

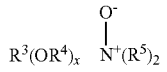

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$-$C_{18}$ alkyl dimethylamine oxide, and $C_{10-18}$ acylamido alkyl dimethylamine oxide.

Enzyme

Suitable proteases include metalloproteases and serine proteases, including neutral or alkaline microbial serine proteases, such as subtilisins (EC 3.4.21.62). Suitable proteases include those of animal, vegetable or microbial origin. Microbial origin is preferred. Chemically or genetically modified mutants are included. The protease may be a serine protease, preferably an alkaline microbial protease or a chymotrypsin or trypsin-like protease. Examples of neutral or alkaline proteases include:

(a) subtilisins (EC 3.4.21.62), especially those derived from Bacillus, such as *Bacillus lentus, B. alkalophilus, B. subtilis, B. amyloliquefaciens, Bacillus pumilus* and *Bacillus gibsonii* described in U.S. Pat. Nos. 6,312,936 B1, 5,679,630, 4,760,025, DEA6022216A1 and DEA 6022224A1.

(b) trypsin-like or chymotrypsin-like proteases, such as trypsin (e.g., of porcine or bovine origin), the *Fusarium* protease described in WO 89/06270 and the chymotrypsin proteases derived from *Cellumonas* described in WO 05/052161 and WO 05/052146.

(c) metalloproteases, especially those derived from *Bacillus amyloliquefaciens* decribed in WO 07/044993A2.

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novo Nordisk A/S (Denmark), those sold under the tradename Maxatase®, Maxacal®, Maxapem®, Properase®, Purafect®, Purafect Prime®, Purafect Ox®, FN3®, FN4® and Purafect OXP® by Genencor International, and those sold under the tradename Opticlean® and Optimase® by Solvay Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, W096/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484 that also preferably contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

Suitable commercially available alpha-amylases are DURAMYL®, LIQUEZYME® TERMAMYL®, TERMAMYL ULTRA®, NATALASE®, SUPRAMYL®, STAINZYME®, STAINZYME PLUS®, FUNGAMYL® and BAN® (Novozymes A/S), BIOAMYLASE-D(G), BIOAMYLASE® L (Biocon India Ltd.), KEMZYM® AT 9000 (Biozym Ges. m.b.H, Austria), RAPIDASE®, PURASTAR®, OPTISIZE HT PLUS® and PURASTAR OXAM® (Genencor International Inc.) and KAM® (KAO, Japan). In one aspect, preferred amylases are NATALASE®, STAINZYME® and STAINZYME PLUS® and mixtures thereof.

Enzyme form—The enzyme can be provided either in the form of a low-dusting solid (typically a granule or prill) or as a stabilized liquid or as a protected liquid or encapsulated enzyme. Numerous techniques are described in the art to produce low-dusting solid forms of enzymes, including prilling, extrusion, spheronization, drum granulation and fluid bed spray coating and exemplified in U.S. Pat. Nos. 4,106,991; 4,242,219; 4,689,297, 5,324,649 and 7,018,821 which are herein incorporated by reference. Liquid enzyme preparations may, for instance, be stabilized by adding a polyol such as propylene glycol, a sugar or sugar alcohol, lactic acid or boric acid according to established methods. Protected liquid enzymes or encapsulated enzymes may be prepared according to the methods disclosed in U.S. Pat. Nos. 4,906,396, 6,221,829, 6,359,031 and 6,242,405 which are herein incorporated by reference.

Enzyme stabilizer components—Suitable enzyme stabilizers include oligosaccharides, polysaccharides and inorganic divalent metal salts, such as alkaline earth metal salts, especially calcium salts. Chlorides and sulphates are preferred with calcium chloride an especially preferred calcium salt. Examples of suitable oligosaccharides and polysaccharides, such as dextrins, can be found in WO07/145964A2 which is incorporated herein by reference. In case of aqueous compositions comprising protease, a reversible protease inhibitor, such as a boron compound, including borate and 4-formyl phenyl boronic acid or a tripeptide aldehyde, can be added to further improve stability.

Low Cloud Point Non-Ionic Surfactants and Suds Suppressers

The suds suppressers suitable for use herein include nonionic surfactants having a low cloud point. As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

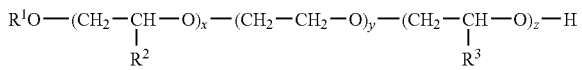

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Dispersant Polymer

The polymer, if used, is used in any suitable amount from about 0.1% to about 50%, preferably from 1% to about 20%, more preferably from 2% to 10% by weight of the composition. Sulfonated/carboxylated polymers are particularly suitable for the compositions contained in the pouch of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

(I)

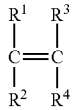

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

(II)

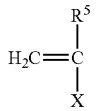

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

(III)

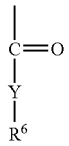

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

(IV)

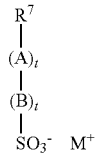

wherein $R^7$ is a group comprising at least one $Sp^2$ bond, A is O, N, P, S or an amido or ester linkage, B is a mono- or polycyclic aromatic group or an aliphatic group, each t is independently 0 or 1, and $M^+$ is a cation. In one aspect, $R^7$ is a $C_2$ to $C_6$ alkene. In another aspect, $R^7$ is ethane, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Abbreviations Used in Examples

In the examples, the abbreviated component identifications have the following meanings:

Carbonate: Anhydrous sodium carbonate

STPP: Sodium tripolyphosphate anhydrous

Silicate: Amorphous Sodium Silicate ($SiO_2$:$Na_2O$=from 2:1 to 4:1)

Alcosperse 240: Sulfonated polymer available from Alco Chemical, 40-45% solids

Alcosperse 240-D: Sulfonated polymer available from Alco Chemical 95% solids

Percarbonate: Sodium percarbonate of the nominal formula $$2Na_2CO_3.3H_2O_2$$

TAED: Tetraacetylethylenediamine

Detergency enzyme: available from Novo Nordisk AIS

SLF18: low foaming surfactant available from BASF

LF404: low foaming surfactant available from BASF $C_{14}$AO: tetradecyl dimethyl amine oxide $C_{16}$AO: hexadecyl dimethyl amine oxide DPG: dipropylene glycol In the following examples all levels are quoted in grams.

The compositions of the examples below are introduced into a multi-compartment pouch having a first compartment comprising a solid composition (in powder form) and two side-by-side liquid compartments superposed onto the powder compartment comprising the liquid compositions. The film used is Monosol M8630 film as supplied by Monosol. The weight of the solid composition is 19 grams and the weight of each of the liquid compositions is 1 gram.

EXAMPLES

| | Example | | | |
|---|---|---|---|---|
| | 1 | 2 | 3 | 4 |
| Solid composition | | | | |
| $C_{14}$AO | 5 | | 5 | |
| $C_{16}$AO | | 5 | | 5 |
| ACNI | 5 | | | 5 |
| SLF18 | | 5 | 5 | |
| STPP | 55 | 55 | 56 | 56 |
| HEDP | 1 | 1 | 1 | 1 |
| Enzyme | 2.5 | 2.5 | 2.5 | |
| Percarbonate | 15 | 15 | 16.5 | 16.5 |
| Carbonate | 10 | 9 | 10 | 10 |
| Silicate | 6 | 7 | 7 | 7 |
| Perfume | 0.5 | 0.5 | 0.5 | 0.5 |
| $1^{st}$ Liquid composition | | | | |
| DPG | 45 | 45 | 45 | 44 |
| SLF18 | 45 | 45 | 45 | 46 |
| Enzyme | | | | 1 |
| Perfume | 1 | 1 | 1 | 1 |
| Minors | 9 | 9 | | 8 |
| $2^{nd}$ Liquid composition | | | | |
| DPG | 90 | 90 | 80 | 50 |
| SLF18 | | | | 46 |
| Enzyme | 2 | 3 | 4 | |
| Alcosperse 240D | | | 6 | |
| Minors | 8 | 7 | 10 | 5 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent multi-compartment pouch having a plurality of water-soluble films forming a plurality of compartments, the pouch comprising:

a compartment containing a composition in solid form, wherein the solid composition comprises bleach; and two side-by-side compartments superposed onto the compartment containing the solid composition, wherein:

the two side-by-side compartments contain compositions in liquid form, one of the two side-by-side compartments contains a liquid composition comprising an enzyme and is formed from at least one of the plurality of water-soluble films, and the at least one of the plurality of water-soluble films has a solubility such as it releases its contents prior to the films that form the compartment containing the bleach-containing composition.

2. A detergent pouch according to claim 1, wherein the solid and liquid compositions are in a weight ratio of from about 20:1 to about 1:20.

3. A detergent pouch according to claim 1, wherein the pouch has a volume of from about 10 ml to about 30 ml and preferably the weight of the solid composition is from about 10 to about 26 grams and the weight of the liquid composition is from about 0.5 to about 4 grams.

4. A detergent pouch according to claim 1, wherein at least two of the films have different solubility.

5. A detergent pouch according to claim 1, wherein said solid and liquid compositions are in a weight ratio of from about 20:1 to about 1:20 and wherein preferably one of the films that form the compartment containing the enzyme-containing composition has a solubility such as it releases its contents prior to the films that form the compartment containing the bleach-containing composition in the main-wash cycle of an automatic dishwashing machine.

6. A detergent pouch according to claim 1, wherein said solid and liquid compositions are in a weight ratio of from about 20:1 to about 1:20 and wherein at least one liquid composition comprises a non-ionic surfactant, preferably having a cloud point above 60°.

7. A detergent pouch according to claim 1, wherein said solid and liquid compositions are in a weight ratio of from about 20:1 to about 1:20 and wherein at least one of the liquid compositions is a rinse aid composition and the films that form the compartment containing the rinse aid is insoluble during the main wash and has a solubility such as it releases its contents in the rinse cycle of an automatic dishwashing machine.

8. A method of dishwashing in an automatic dishwashing machine using a detergent pouch according to claim 5 comprising the steps of:

a) placing the pouch into the dispenser and releasing it during the main-wash cycle; and b) releasing the at least one enzyme-containing composition into the wash liquor prior to the delivery of the bleach-containing composition.

9. A method of dishwashing in an automatic dishwashing machine using a detergent pouch according to claim 7 comprising the steps of:

c) placing the pouch into the dispenser and releasing it during the main-wash cycle; and d) releasing a composition into the wash liquor during the main-wash cycle and at least one liquid compositions into the rinse liquor during the rinse cycle.

10. A detergent pouch according to claim 1, wherein the two side-by-side compartments containing liquid compositions contain two different liquid compositions.

* * * * *